US008379877B2

(12) United States Patent
Yamada

(10) Patent No.: US 8,379,877 B2
(45) Date of Patent: Feb. 19, 2013

(54) SOUND COLLECTOR AND SOUND RECORDER

(75) Inventor: Eiichi Yamada, Tokyo (JP)

(73) Assignee: Sony Corporation (JP)

( * ) Notice: Subject to any disclaimer, the term of this patent is extended or adjusted under 35 U.S.C. 154(b) by 1288 days.

(21) Appl. No.: 12/157,508

(22) Filed: Jun. 11, 2008

(65) Prior Publication Data

US 2008/0310649 A1 Dec. 18, 2008

(30) Foreign Application Priority Data

Jun. 13, 2007 (JP) ..... P2007-155867

(51) Int. Cl.
*H04R 3/00* (2006.01)

(52) U.S. Cl. ..... 381/92; 381/111; 381/123; 381/81

(58) Field of Classification Search ..... 381/91–92, 381/122, 111, 113–114, 375, 355, 123, 81
See application file for complete search history.

(56) References Cited

U.S. PATENT DOCUMENTS

| | | | | |
|---|---|---|---|---|
| 4,817,153 | A * | 3/1989 | Fernandez | 381/26 |
| 7,587,055 | B2 * | 9/2009 | Kujirai et al. | 381/92 |
| 2003/0185410 | A1 * | 10/2003 | June et al. | 381/94.1 |
| 2006/0045485 | A1 * | 3/2006 | Kawamura | 386/95 |

FOREIGN PATENT DOCUMENTS

JP 2007-043510 A 2/2007

* cited by examiner

*Primary Examiner* — Disler Paul
(74) *Attorney, Agent, or Firm* — Lerner, David, Littenberg, Krumholz & Mentlik, LLP

(57) ABSTRACT

A sound collector includes a first microphone unit and a second microphone unit having a single directivity and being pivotally supported in a manner that directions of directional axes of the units are changeable in an identical flat plane and a switch to be controlled in conjunction with the rotations of the first and the second microphone units. Output signals of the first and the second microphone units are outputted with channels of the signals being exchanged or non-exchanged by the switch in accordance with an angle formed by the directional axes.

3 Claims, 8 Drawing Sheets

SOUND COLLECTOR AND SOUND RECORDER

CROSS-REFERENCE TO RELATED APPLICATIONS

The present application claims priority from Japanese Patent Application No. JP 2007-155867, filed in the Japanese Patent Office on Jun. 13, 2007, the entire content of which is incorporated herein by reference.

BACKGROUND OF THE INVENTION

1. Field of the Invention

The present invention relates to a sound collector and a sound recorder.

2. Description of Related Art

Examples of portable stereo sound recorders include those in which microphone units for collecting sounds are in an XY arrangement. FIG. 8A is a plan view showing the arrangement of the sound recorder of this type and the microphone units. A sound recorder 10 has the shape of a rectangular parallelepiped of approximately 70 mm (width)×150 mm (depth)×30 mm (thickness), and the front thereof is provided with a pair of microphone units 11L and 11R.

In this case, the microphone units 11L and 11R have uni-directivity. It is preferable if the microphone units 11L and 11R are arrange such that diaphragms (not shown) thereof are orthogonalized each other. However, practically it is difficult to arrange to be orthogonal, therefore the microphone units 11L and 11R are arranged such that the sound collecting openings of the units are sufficiently close to each other, and respective directional axes 12L and 12R of the units are orthogonal to each other in the identical horizontal plane.

With this configuration, as shown in FIG. 8B, regions 13L and 13R become main sound collection ranges (directional ranges) of the microphone units 11L and 11R, respectively, and high sensitivity in the depth direction can be obtained, thereby attaining stereo sounds and images having impression of depth. It is therefore suitable for recording solo performance or the like.

As a prior art document, the following may be referred to. (Japanese Unexamined Patent Application Publication No. 2007-043510, Patent Document 1)

SUMMARY OF THE INVENTION

However, in the sensitivity characteristics shown in FIG. 8B, the sound collection range in the right-to-left direction is somewhat narrow, and it is therefore unsuitable for sound collection of the sound source expanding to right-to-left fields, such as orchestra. For example, when recording in the situations where a train running from the left remote location gets close to a person, passes in front of the person, and then runs to the right remote location, the impression of expanding fields cannot be properly reproduced.

Accordingly, in an embodiment of the present invention, it is desirable to solve the issue and also solve newly caused issues.

The sound collector of one embodiment of the invention includes first and second microphone units having uni-directivity and being pivotally supported so that the directions of respective directional axes may be changed in an identical plane, and a switch controlled in conjunction with the rotations of the first and the second microphone units. The output signals of the first and the second microphone units are outputted by causing the switch to execute either of exchange and non-exchange of the channels of these output signals in accordance with an angle formed by the directional axes.

According to embodiments of the present invention, the directions of the directional axes of the first and the second microphone units can be changed and the stereo mode and the expansion field of sound can be set freely in accordance with the sound source to be recorded, whereby allowing optimum sound collection and sound recording in accordance with the sound source.

DETAILED DESCRIPTION OF THE EMBODIMENTS

1A. Configuration Example

Description of First Half

Figure 1:
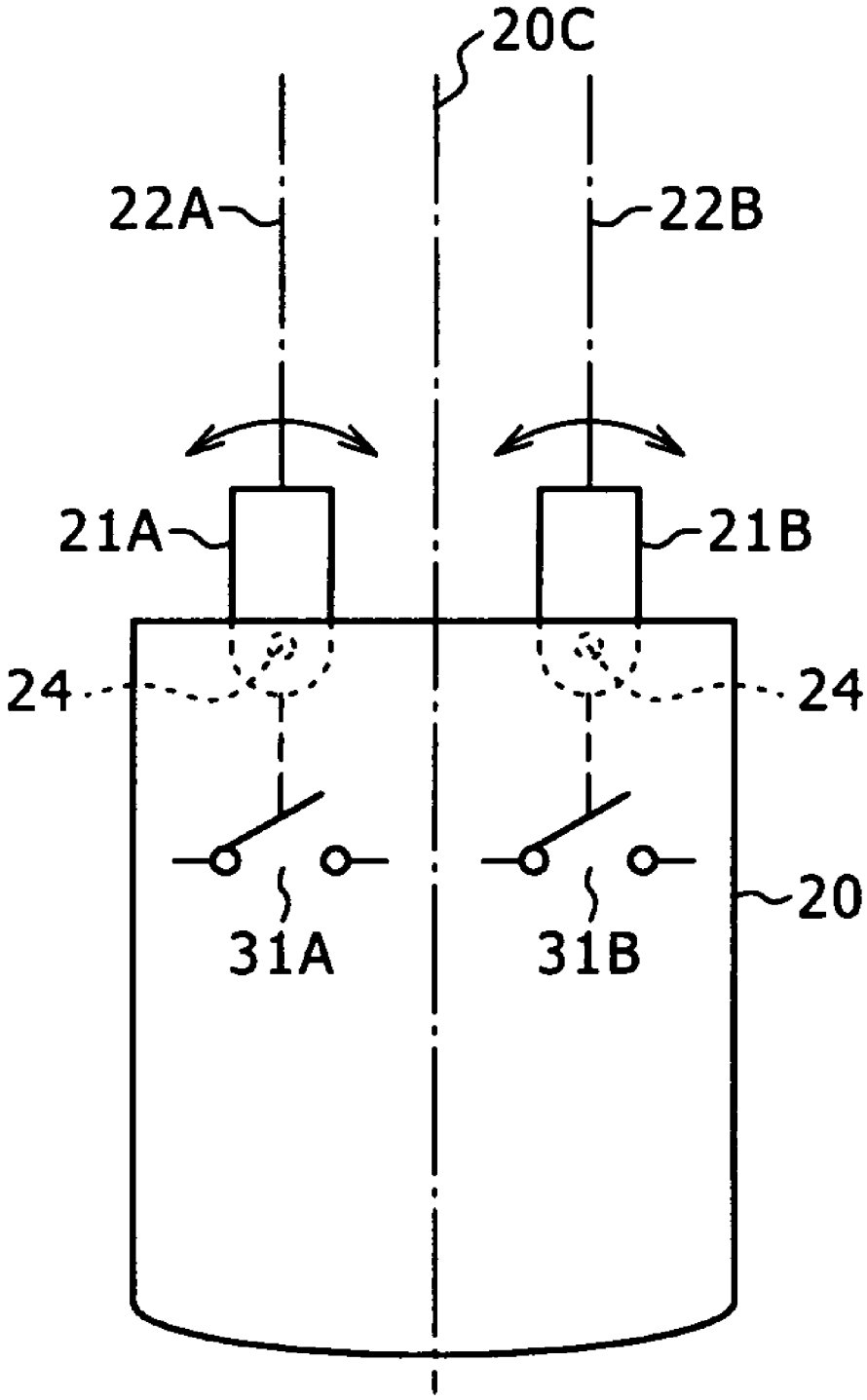
FIG. 1 is a plan view showing an embodiment of the present invention.

FIG. 1 is a plan view showing an example of the external view when the present invention is applied to a portable stereo sound recorder. Reference numeral 20 indicates the entire sound recorder. The dot-dash line 20C indicates the center line in the front-back direction of the recorder 20.

The sound recorder 20 is configured in the shape of substantially a flat rectangular parallelepiped as a whole. A pair of microphone units 21A and 21B are provided at the front portion of the recorder by keeping a predetermined space, for example, 8 cm to 9 cm, between the units.

Figure 2A:
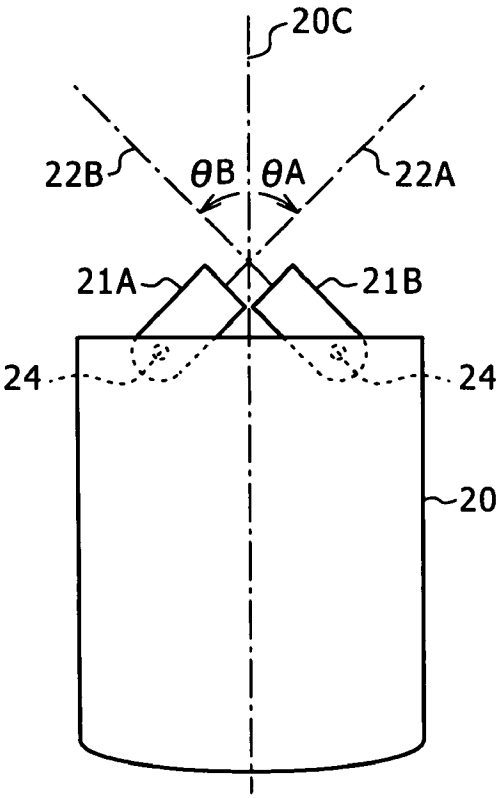
FIGS. 2A to 2C are plan views for explaining the present invention.
Figure 2B:
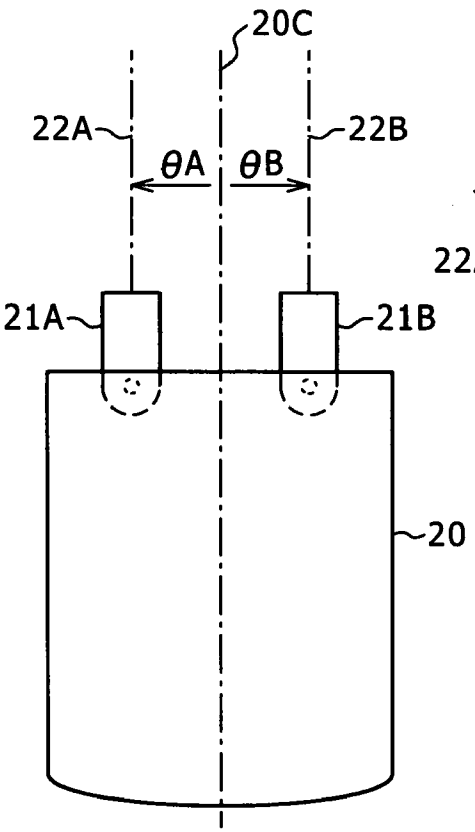
Figure 2C:
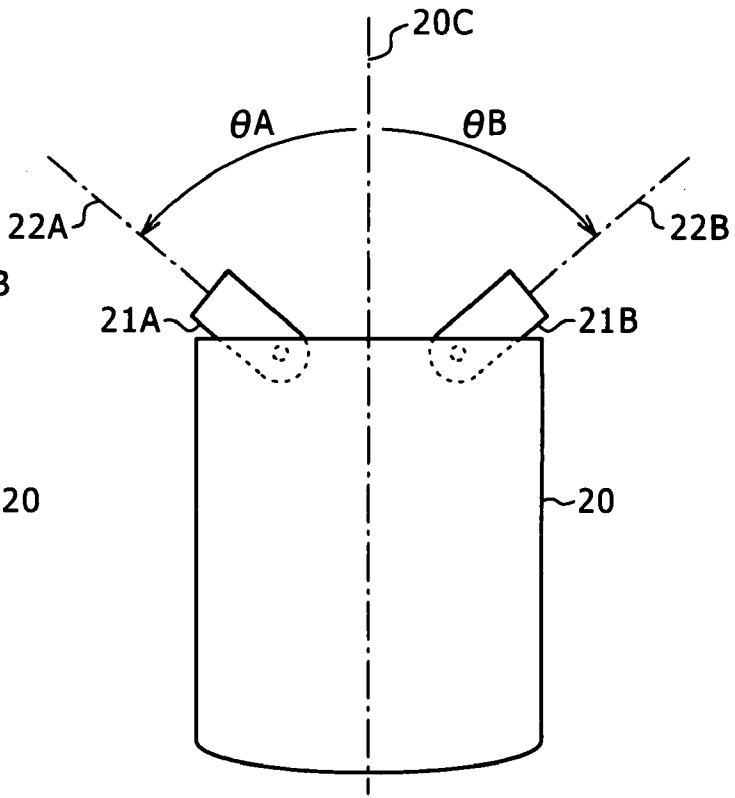

In this case, the directivity of the microphone units 21A and 21B is a uni-directivity. These microphone units 21A and 21B are pivotally supported by pins 24 and 24, respectively in a rotatable manner. As shown in FIGS. 2A to 2C, the directions of directional axes 22A and 22B of the units 21A and 21B can be changed, respectively, in the right-to-left direction in the identical horizontal plane, including the center line 20C.

That is, FIG. 2A shows the case where the microphone units 21A and 21B are rotated such that the directional axes 22A and 22B of the microphone units 21A and 21B are orthogonal to each other, and the sound collecting openings of the microphone units 21A and 21B are sufficiently close to each other. The state shown in FIG. 2A corresponds to the state shown in FIG. 8A.

FIG. 2B shows the case where the microphone units 21A and 21B are rotated such that the directional axes 22A and 22B become parallel to the center line 20C. FIG. 2C shows the case where the microphone units 21A and 21B are rotated so that the directional axes 22A and 22B are in the opening direction.

Based on the center line 20C in the front-back direction of the recorder 20, for example, it is assumed as follows;

θA is the angle formed between the directional axis 22A and the center line 20C. The counterclock direction is positive.

θB is the angle formed between the directional axis 22B and the center line 20C. The clock direction is positive.

Based on the assumptions, the three states can be expressed as follows;

In the state shown in FIG. 2A, θA=θB=−45°;

In the state shown in FIG. 2B, θA=θB=0 (the directional axes 22A and 22B are parallel); and In the state shown in FIG. 2C, θA=θB=60°.

Although not shown, it is arranged that the angles θA and θB can be changed continuously and independently.

As shown in FIG. 1, switches 31A and 31B (described later) are provided in conjunction with the microphone units 21A and 21B, in the recorder 20.

Figure 3A:
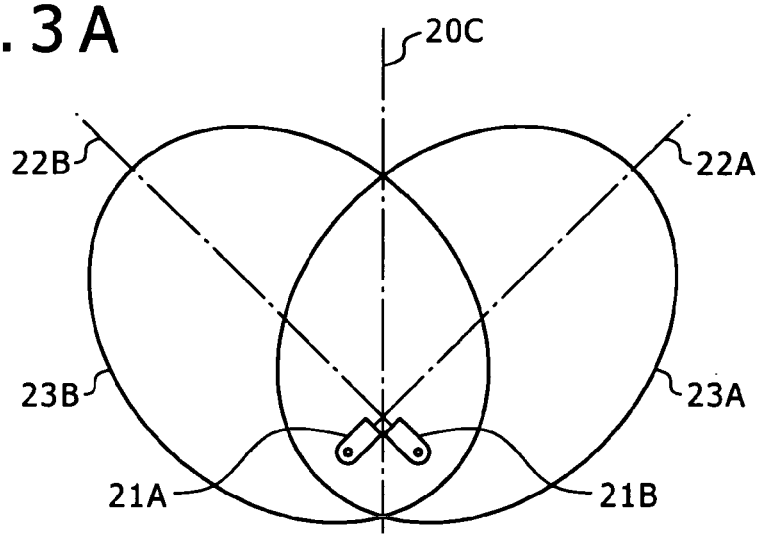
FIGS. 3A to 3C are plan views for explaining the directional properties in the present invention.
Figure 8A:
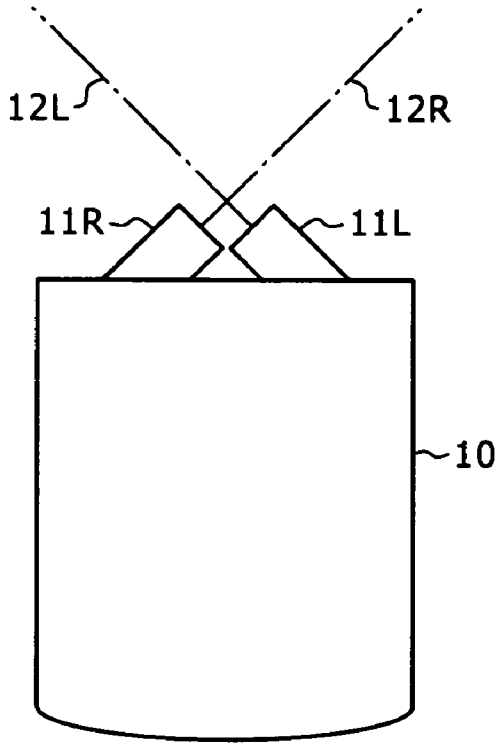
FIGS. 8A and 8B are plan views for explaining the present invention.
Figure 8B:
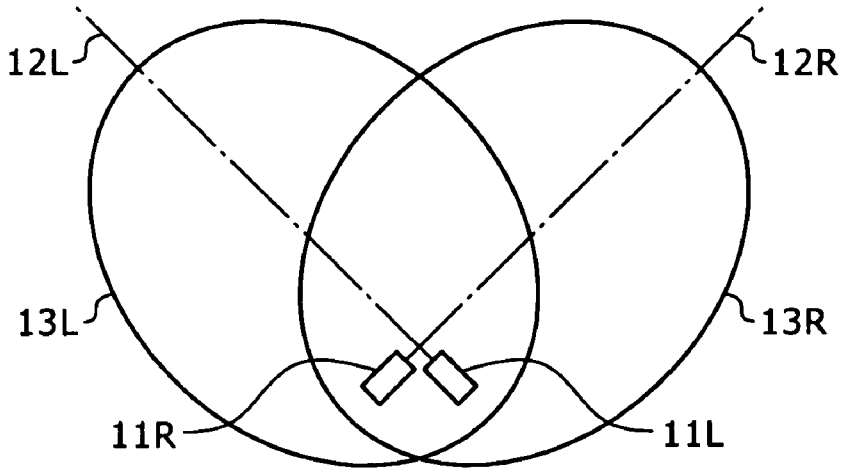

With this configuration, when the microphone units 22A and 22B are in the state shown in FIG. 2A (θA=θB=−45°), which is the same state of that shown in FIG. 8A, the directional properties shown in FIG. 3A can be obtained, as similar with the case of FIG. 8B. Accordingly, the regions 23A and 23B become the main sound collection ranges of the microphone units 21A and 21B, respectively. Thus, because high sensitivity in the depth direction can be achieved, stereo sounds and images with an impression of depth may be obtained, thereby making the units suitable for recording solo performance or the like.

Figure 3B:
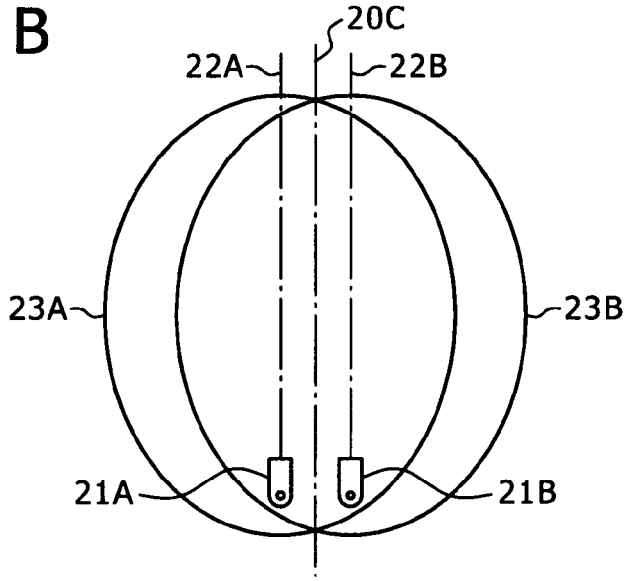

When the microphone units 22A and 22B are in the state shown in FIG. 2B (θA=θB=0), the directional properties shown in FIG. 3B can be obtained, and the regions 23A and 23B become the main sound collection ranges of the microphone units 21A and 21B, respectively. Therefore, although stereo mode is weak, very high sensitivity with respect to the sounds from the front side can be obtained, thereby making the units suitable for recording a sound of a specific sound source.

Figure 3C:
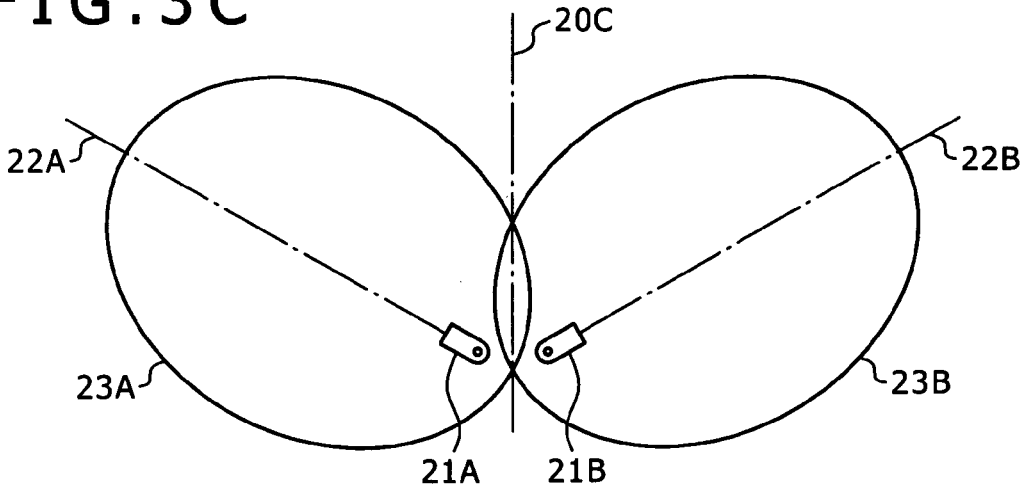

When the microphone units 22A and 22B are in the state shown in FIG. 2C (θA=θB=60°), the directional properties as shown in FIG. 3C can be obtained, and the regions 23A and 23B become the main sound collection ranges of the microphone units 21A and 21B, respectively. Therefore, stereo sounds and images having impression of expanded in right and left can be obtained, thereby making the units suitable for recording orchestra performance or the like. Alternatively, when recording the situations where a train gradually gets close from the left remote location and passes in front of a person and runs to the right remote location, impression of expansion may be properly reproduced.

1B. Configuration Example

Description of Latter Part

If configurations are limited to the above, the following problem in terms of audio signals (sound collection signals) outputted from the microphone units 21A and 21B may occur, in the case of FIG. 2A and in the case of FIG. 2C (and FIG. 2B).

That is, the state shown in FIG. 2A leads to the following results:

The output of the microphone unit 21A is equal to the audio signal of the right channel; and The output of the microphone unit 21B is equal to the audio signal of the left channel.

On the other hand, the state shown in FIG. 2C leads to the following results:

The output of the microphone unit 21A is equal to the audio signal of the left channel; and The output of the microphone unit 21B is equal to the audio signal of the right channel. Thus, the channels of the audio signals to be outputted from the microphone units 21A and 21B are reversed between the state shown in FIG. 2A and the state shown in FIG. 2C.

Figure 4:
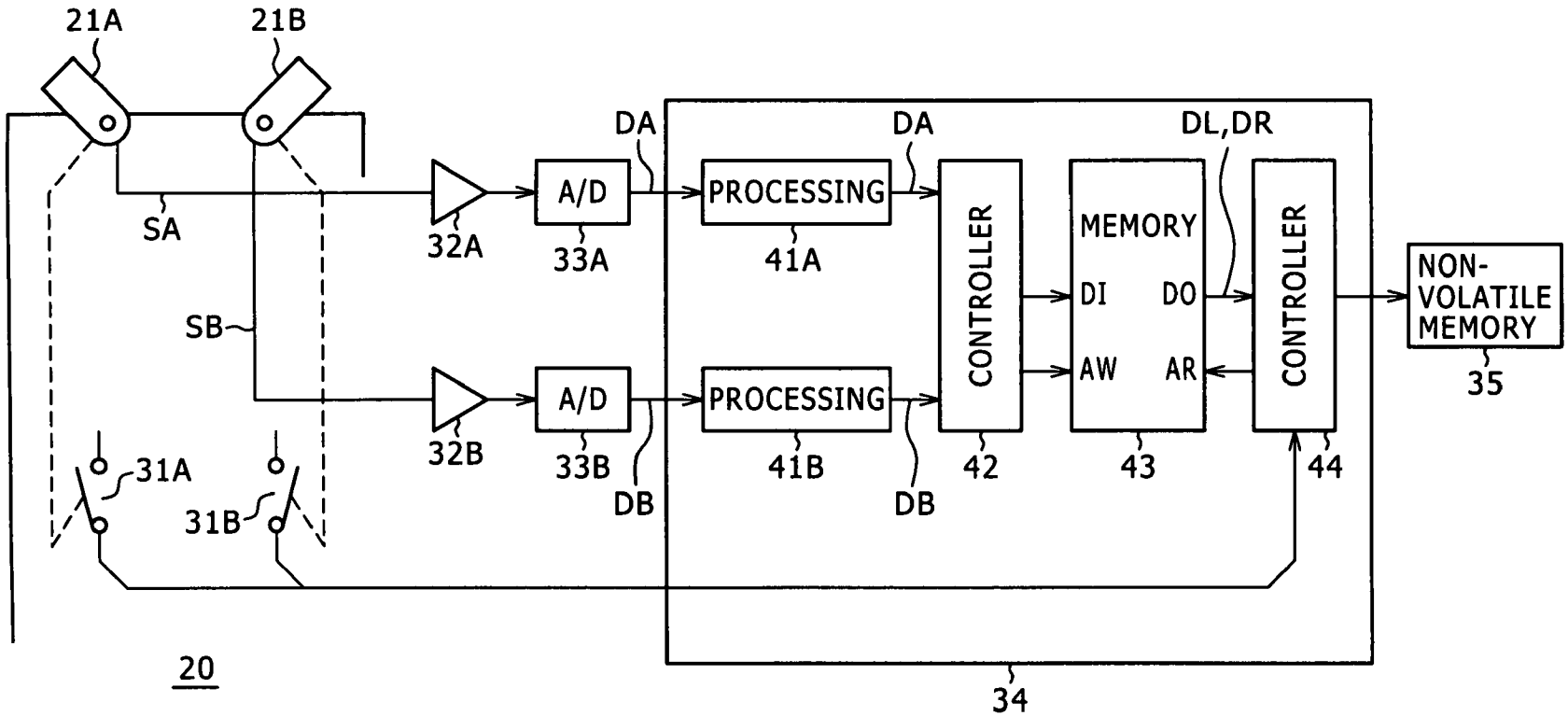
FIG. 4 is a schematic diagram showing an embodiment of the present invention.

Consequently, in the present invention, the circuit for recording audio signals has, for example, the structure as shown in FIG. 4. That is, audio signals SA and SB outputted from the microphone units 21A and 21B are supplied via preamplifiers 32A and 32B to A/D (analog to digital) converter circuits 33A and 33B to be converted into digital audio signals DA and DB, respectively. These digital audio signals DA and DB are then supplied to preprocessing circuits 41A and 41B, respectively.

In the preprocessing circuits 41A and 41B, the digital audio signals DA and DB are subjected to, for example, limiter processing, equalizer processing, and so-called SBM (super bit mapping, registered trademark) processing in which quantization noise is shifted to high frequency where grating on ear is avoided, by use of noise shaping technique. The preprocessing circuits 41A and 41B are integrated into a one-chip IC (integrated circuit) 34, together with the following circuits 42 to 44.

The preprocessed digital audio signals DA and DB are written sequentially in a buffer memory 43 by a write memory controller 42, and the written digital audio signals DA and DB are read sequentially by a read memory controller 44.

The switches 31A and 31B are provided to receive an on-off control in conjunction with the rotations of the microphone units 21A and 21B (the changes in the angle θA and the angle θB of the directional axes 22A and 22B), and the switch outputs are supplied to the memory controller 44 as the control signals of read addresses, respectively.

Subsequently, the digital audio signals DA and DB are read from the memory 43 as follows.

Specifically, when the directional axes 22A and 22B are crossed (for example, the state shown in FIG. 2A), these two signals are read as follows:

The signal DA is the digital audio signal DR of the right channel; and

The signal DB is the digital audio signal DL of the left channel.

When the directional axes 22A and 22B are not crossed (for example, the states shown in FIGS. 2B and 2C), these two signals are read as follows:

The signal DA is the digital audio signal DL of the left channel; and

The signal DB is the digital audio signal DR of the right channel.

The read digital audio signals DL and DR of the left and right channels are then written, namely recorded sequentially through the controller 44 into a recording media, which is a non-volatile memory 35 in this example.

The non-volatile memory 35 may be a memory contained in the recorder 20, or alternatively may be a removable memory card. In either case, by employing the USB (universal serial bus) configuration, the contents of the memory 35 can be transferred to and reproduced on an external personal computer or the like. When the non-volatile memory is a memory card, the memory card can be removed from the recorder 20 and reproduced by a personal computer or the like.

In this manner, in the recorder 20 shown in FIG. 4, in accordance with the angle formed between the directional axes 22A and 22B of the microphone units 21A and 21B, the audio signals outputted from the microphone units 21A and 21B are classified to the digital audio signals of the left channel and the right channel, and then written in the non-volatile memory 35.

Therefore, even if the microphone units 21A and 21B are in the state shown in FIG. 2A or in the states shown in FIGS. 2B, or 2C, the digital audio signals DA and DB of the left and right channels may be properly recorded in the non-volatile memory 35.

2. Summary

In accordance with the recorder 20, the correct states can be recorded in a memory by the exchange of the channels of the audio signals collected by the microphone units 21A and 21B between the state shown in FIG. 2A and the state shown in FIG. 2C. Since the directions of the directional axes 22A and 22B of the microphone units 21A and 21B can be freely and continuously changed between the state shown in FIG. 2A and the state shown in FIG. 2C (via the state shown in FIG. 2B), the stereo mode and the degrees of expansion can be freely set depending on the sound source to be recorded, thereby allowing optimum sound collection and sound recording.

Figure 5B:
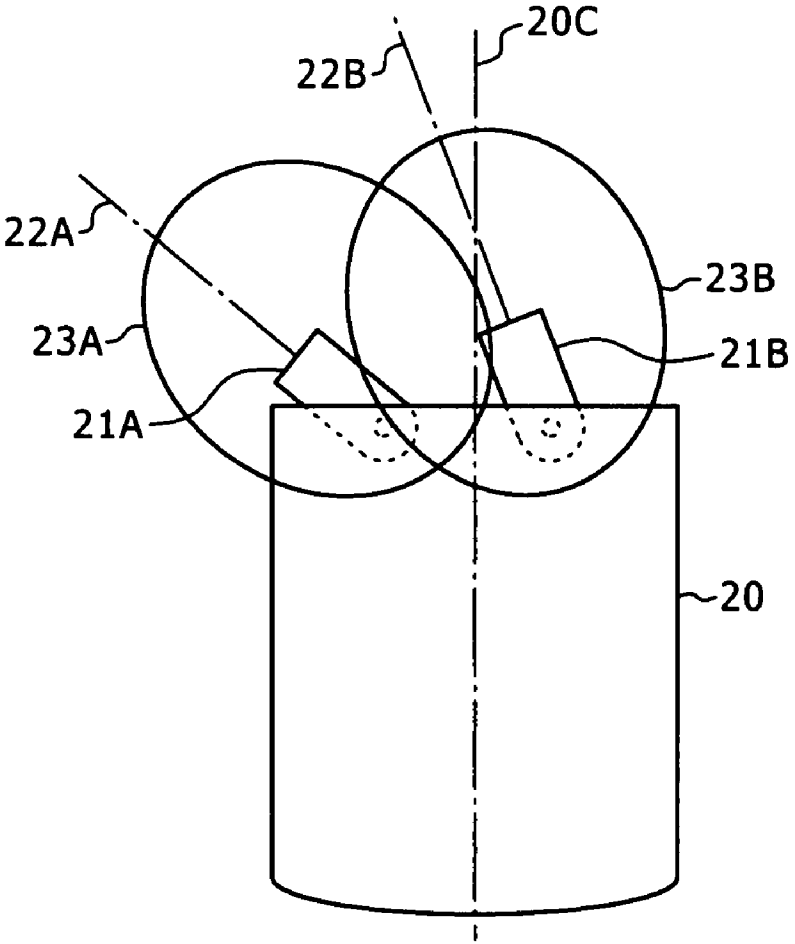
FIGS. 5A and 5B are plan views for explaining the use situations in an embodiment of the present invention.
Figure 5A:
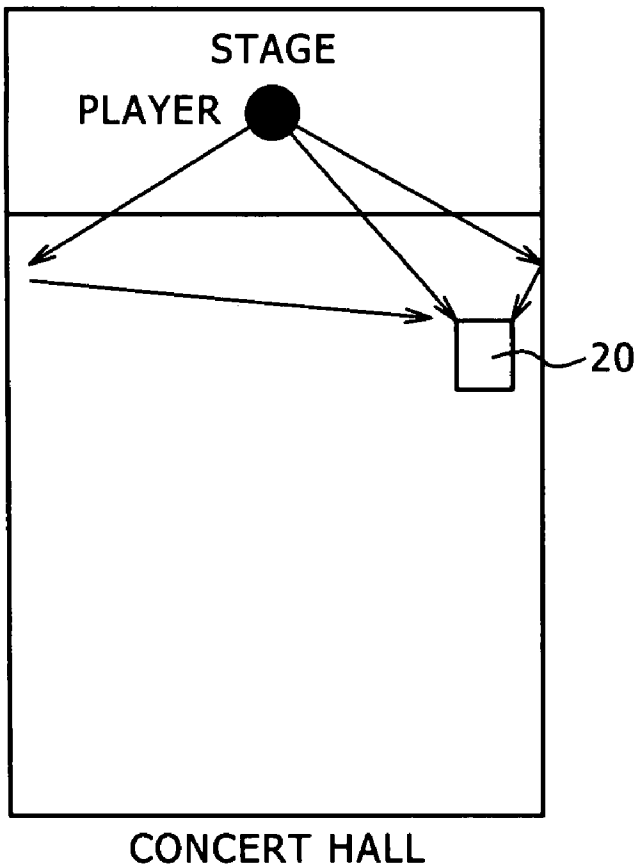

For example, as shown in FIG. 5A, when recording is performed with the recorder 20 set at the right position of a concert hall, the sounds of concert performance from musical instruments reach the microphone units 21A and 21B of the recorder 20 through various passages. Therefore, as shown in FIG. 2C, when the directions of the directional axes 22A and 22B of the microphone units 21A and 21B are symmetric with respect to the center line 20C of the recorder 20, namely when $\theta A=\theta B$, the microphone unit 21B may collect and record more reflected sound components from the right wall surface than the microphone unit 21A.

However, the recorder 20 allows the directions of the directional axes 22A and 22B of the microphone units 21A and 21B to be set independently. Accordingly, in the case of the situation shown in FIG. 5A, by setting directions of the directional axes 22A and 22B of the microphone units 21A and 21B as those as shown in FIG. 5B, the sound components reflected from the right wall surface may be reduced and recording with a appropriate left/right sound balance becomes possible.

Figures 6A, 6B, 6C:
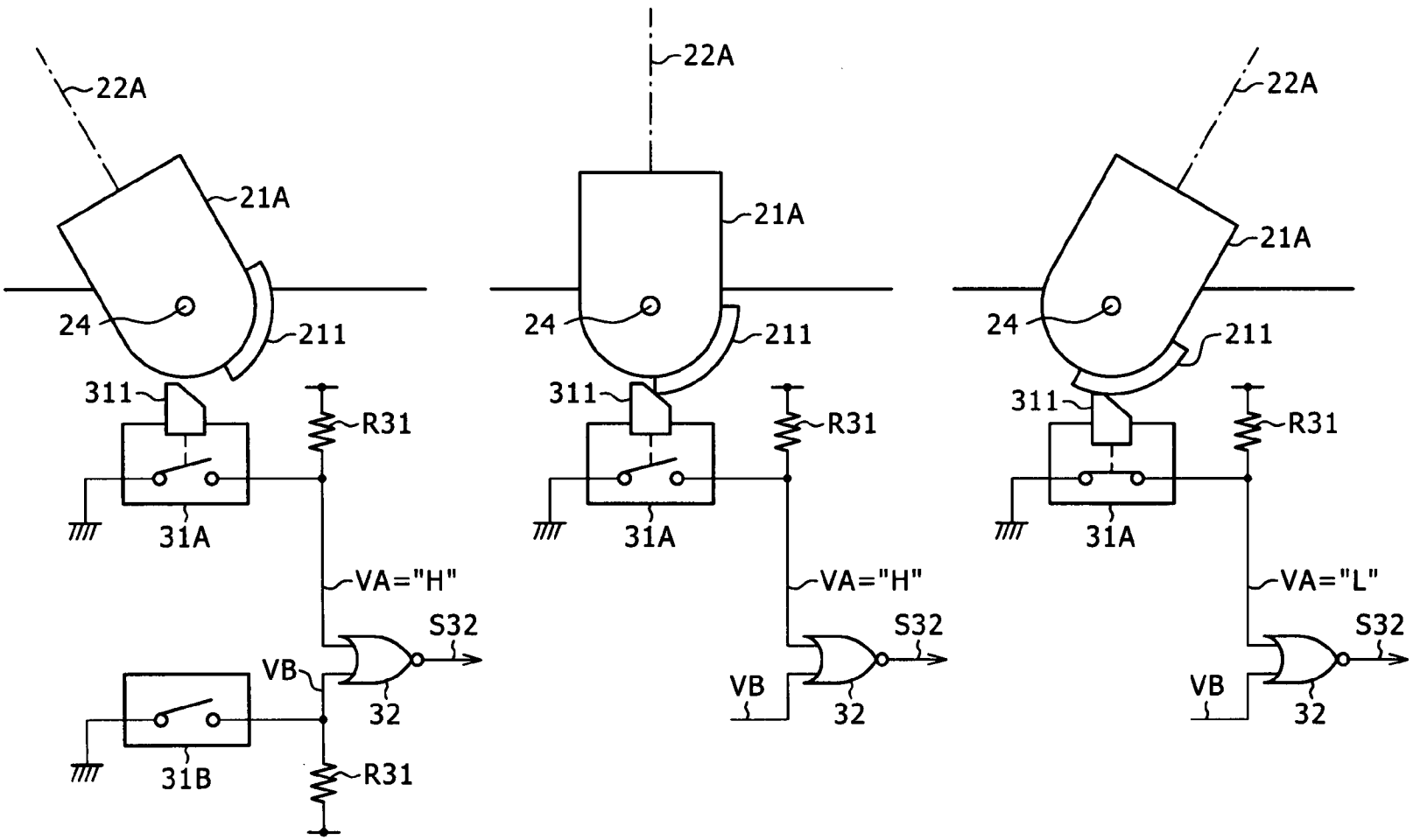
FIGS. 6A to 6C are diagrams for explaining an embodiment of a part of the mechanism and the circuit in the present invention.

3. Examples of Mechanism of Microphone Units and Switches, which Move in Conjunction with Each Other FIGS. 6A to 6C show one example of the mechanisms between the microphone units 21A and 21B and the switches 31A and 31B, which move in conjunction with each other. Since the relation between the microphone units 21A and the switch 31A is the same as the relation between the microphone unit 21B and the switch 31B, FIGS. 6A to 6C exemplify only the relation between the microphone unit 21A and the switch 31A. Further, directions of the directional axis 22A of the microphone unit 21A in FIGS. 6A, 6B and 6C corresponds to those in FIGS. 2C, 2B to 2A, respectively.

In FIGS. 6A to 6C, a convex portion 211 is integrally formed with the circumferential surface of the back portion of the microphone unit 21A along the rotating direction. At the position facing to the back portion of the microphone unit 21A, for example, a micro switch is provided as the switch 31A, and an actuator 311 of the switch 31A is provided so as to correspond to the convex portion 211. For example, the microphone switch 31A may be a normal open switch.

One input terminal of a NOR circuit 32 is pulled up by a resistor R31, and the switch 31A is connected between the input terminal and the grounding. The microphone unit 21B and the switch 31B are similarly configured and connected to the NOR circuit 32.

With this configuration, in the state shown in FIGS. 6A and 6B, that is, in the state where the directional axis 22A of the microphone unit 21A does not cross with the center axis 20C ($\theta A \geqq 0$), the convex portion 211 does not press the actuator 311, and accordingly the switch 31A is set to be the off state and the output voltage VA of the switch 31A becomes "H" level.

On the other hand, in the state shown in FIG. 6C, that is, in the state where the directional axis 22A of the microphone unit 21A crosses with the center axis 20C ($\theta A<0$), the convex portion 211 presses the actuator 311, and accordingly the switch 31A is set to be the on state, and the output voltage VA becomes "L" level.

The output voltage VB of the switch 31B becomes either "H" level or "L" level in accordance with the angle $\theta B$ of the directional axis 22B of the microphone unit 21B.

Accordingly, when the directional axes 22A and 22B of the microphone units 21A and 21B are in the state shown in FIG. 2A, an output signal S32 of the NOR circuit 32 becomes "H" level, whereas in the state shown in FIG. 2B or 2C, the output signal S32 of the NOR circuit 32 becomes "L" level. Thus, by supplying the NOR signal S32 to the memory controller 44 as read control signal, as described in the 1B, the audio signals SA and SB outputted from the microphone units 21A and 21B may be properly recorded in the non-volatile memory 35, as the digital audio signal DL or DR of the left or right channel.

4. Other Examples

Figure 7:
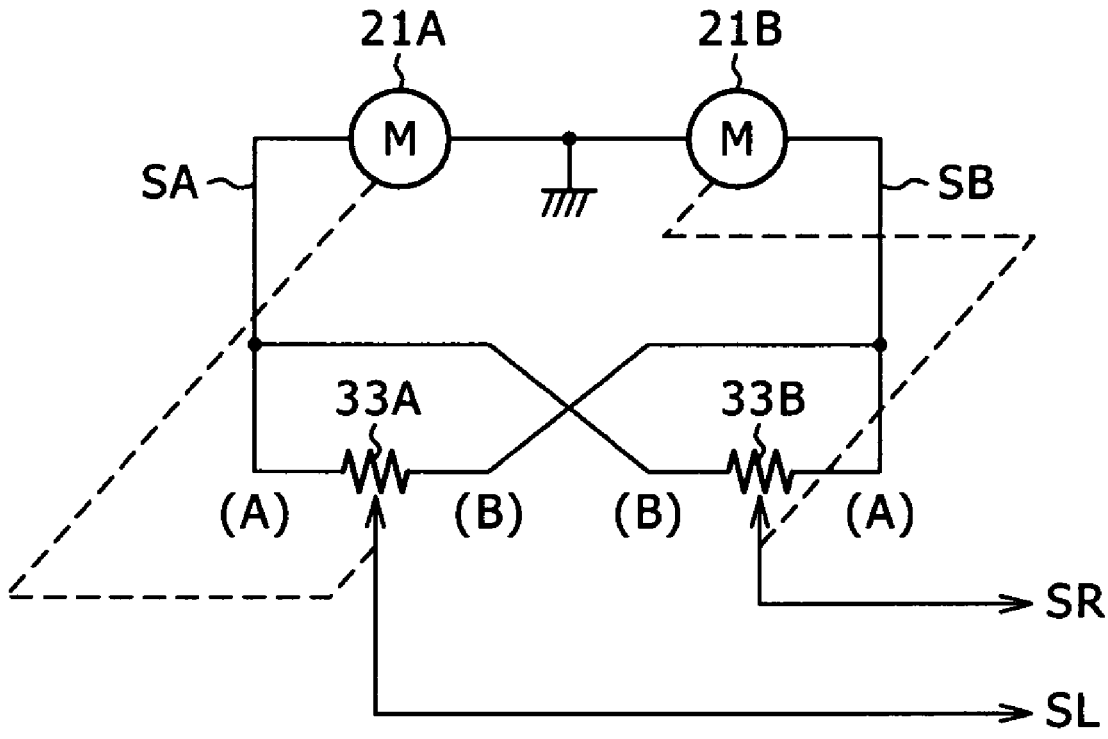
FIG. 7 is a diagram for explaining other embodiment of a part of the circuit in the present invention.

FIG. 7 shows other example of the configuration that prevents the channels of audio signals from being reversed due to the directions of the directional axes 22A and 22B of the microphone units 21A and 21B. That is, in this example, variable resistors 33A and 33B in conjunction with the rotations of the microphone units 21A and 21B, respectively are provided. The output audio signal SA of the microphone unit 21A is supplied to one terminal (A) of each of the variable resistors 33A and 33B, and the output audio signal SB of the microphone unit 21B is supplied to the other terminal B of each of the variable resistors 33A and 33B.

The output signals of the needles of the variable resistors 33A and 33B are extracted as the audio signals SL and SR of the left and right channels, respectively. In this example, even if the directions of the directional axes 22A and 22B of the microphone units 21A and 21B are changed, channel is not reversed while reading is performed in the memory controller 44.

With this configuration, when the microphone units 21A and 21B are in the state shown in FIG. 2A, the signals SB and SA on the terminals (B) side of the variable resistors 33A and 33B are extracted as the signals SL and SR, respectively, and the extracted signals serve as the audio signals of the left and right channels, respectively.

When the microphone units 21A and 21B are in the state shown in FIG. 2C, the signals SA and SA on the terminals (A) side of the variable resistors 33A and 33B are extracted as the signals SL and SR, and the extracted signals serve as the audio signals of the left and right channels.

When the microphone units 21A and 21B are in the state shown in FIG. 2B, mixed signals consisting of the signals on the terminals (A) side and the terminal (B) side of the variable resistors 33A and 33B are extracted as signals SL and SR.

In addition, the directions of the directional axes 22A and 22B of the microphone units 21A and 21B may be continuously changed, and correspondingly the contents of the output audio signals SL and SR (the signals SA and SB) of the variable resistors 33A and 33B change continuously, thereby allowing the impression of expansion and stereo mode to be continuously changed.

5. Others

In the example shown in FIG. 4, when microphone units are in the state shown in FIG. 2A, the controller 44 switches the addresses when the digital audio signals DL and DR are read from the memory 43, thereby preventing the inversion of the right and left channels. Alternatively, the controller 42 may switch the addresses when the digital audio signals DA and DB are written in the memory 43, thereby preventing the inversion of the right and left channels. Further, the inversion of the right and left channels may be prevented by switching the signal lines from the microphone units 21A and 21B to the controller 42.

When one of the microphone units 21A and 21B is rotated, the directions of the directional axes 22A and 22B may be correspondingly changed to satisfy "θA=θB". Further, a non-directional microphone unit may be arranged between the microphone units 21A and 21B, and its output audio signals may be distributed to the right and left channels, in order to avoid so-called lack of middle range.

Further, the directional axes 22A and 22B of the microphone units 21A and 21B may have an elevation angle or a depression angle. When the voice and sounds of an object are collected/recorded by mounting these units on a movie camera, the zooming mechanism may operate in conjunction with the rotation mechanism of the microphone units 21A and 21B, so that the angle of views and directional properties while capturing images match. In other words, these two units may be brought into the state shown in FIG. 2A at telescopic imaging, and to the state shown in FIG. 2C at wide-angle imaging.

LIST OF ABBREVIATIONS

A/D: Analog to Digital
IC: Integrated Circuit
SBM: Super Bit Mapping (registered trademark)
USB: Universal Serial Bus It should be understood by those skilled in the art that various modifications, combinations, sub-combinations and alterations may occur depending on design requirements and other factors insofar as they are within the scope of the appended claims or the equivalents thereof.

What is claimed is:

1. A sound collector comprising:

a first microphone unit and a second microphone unit having a single directivity and being pivotally supported in a manner that directions of directional axes of the units are changeable in an identical flat plane; and a switch to be controlled in conjunction with the rotations of the first and the second microphone units, wherein output signals of the first and the second microphone units are outputted with channels of the signals being exchanged or non-exchanged by the switch in accordance with an angle formed by the directional axes, and wherein output is executed by causing the switch to execute either of exchange and non-exchange of the channels, depending on whether the directional axes of the first and the second microphone units are crossed or not.

2. A sound collector comprising:

a first microphone unit and a second microphone unit, each of said first microphone unit and said second microphone unit has a single directivity and is pivotally supported such that a direction of a directional axis thereof is rotatable; and a switching device to control output of each of said first microphone unit and said second microphone unit, in which the switching device controls the output of said first microphone unit and said second microphone unit such that channels of signals associated therewith are exchanged or non-exchanged depending on whether the directional axes of said first microphone unit and said second microphone unit are crossed or not.

3. A sound recorder comprising:

a first microphone unit and a second microphone unit;

a recording media to record thereon audio signals corresponding to signals collected by the first microphone unit and the second microphone unit; and a switching device, in which each of said first microphone unit and said second microphone unit has a single directivity and is pivotally supported such that a direction of a directional axis thereof is rotatable, and in which the switching device controls output of said first microphone unit and said second microphone unit such that channels of signals associated therewith are exchanged or non-exchanged depending on whether the directional axes of said first microphone unit and said second microphone unit are crossed or not, and so that the audio signals associated therewith are recorded on the recording media.

* * * * *